US010374361B1

(12) United States Patent
Lien et al.

(10) Patent No.: US 10,374,361 B1
(45) Date of Patent: Aug. 6, 2019

(54) POWER SOCKET

(71) Applicant: DELTA ELECTRONICS, INC., Taoyuan (TW)

(72) Inventors: Chin Lien, Taoyuan (TW); Ming-Tang Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/150,719

(22) Filed: Oct. 3, 2018

(30) Foreign Application Priority Data

Jul. 25, 2018 (CN) ..... 2018 1 0826136

(51) Int. Cl.

| | |
|---|---|
| ***H01R 13/639*** | (2006.01) |
| ***H01R 24/70*** | (2011.01) |
| ***H01R 4/64*** | (2006.01) |
| ***H01R 24/68*** | (2011.01) |
| ***H01R 13/627*** | (2006.01) |
| ***H01R 13/652*** | (2006.01) |
| ***H01R 25/00*** | (2006.01) |
| ***H01R 13/74*** | (2006.01) |
| ***H01R 13/426*** | (2006.01) |
| ***H01R 13/436*** | (2006.01) |
| *H01R 103/00* | (2006.01) |

(52) U.S. Cl.
CPC ..... *H01R 13/6395* (2013.01); *H01R 4/64* (2013.01); *H01R 13/426* (2013.01); *H01R 13/4361* (2013.01); *H01R 13/6273* (2013.01); *H01R 13/6392* (2013.01); *H01R 13/652* (2013.01); *H01R 13/743* (2013.01); *H01R 24/68* (2013.01); *H01R 24/70* (2013.01); *H01R 25/006* (2013.01); *H01R 2103/00* (2013.01)

(58) Field of Classification Search
CPC ..... H01R 13/6392; H01R 13/6395; H01R 13/426; H01R 13/4361
See application file for complete search history.

(56) References Cited

U.S. PATENT DOCUMENTS 2,869,094 A * 1/1959 Francis ..... H01R 13/745 439/550
4,302,066 A * 11/1981 Newman ..... H01R 13/6395 439/347

(Continued)

FOREIGN PATENT DOCUMENTS

| | | |
|---|---|---|
| CN | 101976781 A | 2/2011 |
| CN | 104682113 A | 6/2015 |
| CN | 106025714 A | 10/2016 |

*Primary Examiner* — James Harvey
(74) *Attorney, Agent, or Firm* — Kirton McConkie; Evan R. Witt

(57) ABSTRACT

A power socket includes a main body and a latch member. The main body includes a connection seat, a receiving recess and a latching slot. The connection seat is disposed within the receiving recess and configured to electrically connect with a plug passing, when the power plug is fitted in the receiving recess along a first direction. The latching slot is in communication with the receiving recess. The latch member includes an arm slidable along the latching slot from a first position to a second position along a second direction. The arm includes at least one protrusion configured to slide into the receiving recess for engaging with a lateral wall of the power plug when the arm slides towards the second position.

20 Claims, 14 Drawing Sheets

(56) References Cited

U.S. PATENT DOCUMENTS

| | | | | | |
|---|---|---|---|---|---|
| 4,871,323 | A * | 10/1989 | Ohsumi | H01R 13/639 | 439/188 |
| 5,066,247 | A * | 11/1991 | Watson | H01R 13/745 | 248/27.1 |
| 5,775,957 | A * | 7/1998 | Fink | H01R 13/4361 | 439/595 |
| 5,941,730 | A * | 8/1999 | Uchiyama | F02M 37/10 | 439/550 |
| 6,080,004 | A * | 6/2000 | Kovacik | H01R 13/6392 | 439/352 |
| 7,104,830 | B1 * | 9/2006 | Diaz | H01R 13/6395 | 439/347 |
| 2001/0039151 | A1 * | 11/2001 | Tsuji | H01R 13/4223 | 439/752 |
| 2005/0221629 | A1 * | 10/2005 | Woellner | H01R 13/639 | 439/10 |
| 2009/0011637 | A1 * | 1/2009 | Kim, II | H01R 9/20 | 439/578 |

* cited by examiner

POWER SOCKET

FIELD OF THE INVENTION

The present disclosure relates to a power socket, and more particularly to a power socket for enhancing a retaining force between the power socket and a power plug.

BACKGROUND

A power distribution unit (PDU) is a type of power distribution sockets for a cabinet, which includes a plurality of sockets to be served as power sources to provide required power to for example a server and a storage system in a rack of a data center. The application of PDU can make the power distribution in the cabinet more neat, reliable, safe, professional and aesthetic. However, in order to prevent the power plugs of the server and storage system in the rack and the power sockets of the PDU from loosening caused by the human or other unintended conditions, there is a need to enhance the retaining force between the power socket of the PDU and the power plug.

The conventional power socket of the PDU can increase the retaining force between the power plug and the power socket by adding additional accessories. However, the additional accessories fail to match with the original socket structure completely, and does not facilitate to maintain the neat and aesthetic appearance of the cabinet. On the other hand, under the conditions of compliance with the original safety regulations, it is difficult to design the structures of the power socket and the power plug to match with each other. Moreover, the power socket designed to match with a specific power plug won't work with most other power plugs.

Therefore, there is a need of providing a power socket to enhance a retaining force between the power socket and a power plug and overcome the above drawbacks.

SUMMARY

An object of the present disclosure is to provide a power socket for enhancing a retaining force between the power socket and a power plug. With the latch member disposed within the main body of the power socket, it facilitates to achieve the switching operation of latching or unlatching by a manual push-pull operation with one hand. Thus, the retaining force between the power socket and the power plug may be enhanced effectively and the convenience of its operation may be improved. At the same time, it reduces loosening of the power plugs of the server and storage system in the rack and the power sockets of the PDU caused by the human or other unintended conditions.

By adding at least one latching slot within the main body of the power socket to receive at least one latch member, it facilitates the power socket to enhance the retaining force between the power socket and the power plug. It is not necessary to design a customized power socket to meet with the special specification and appearance of the power plug. The power socket is applicable to the general standard power plug. The structural reliability of the power socket may be improved.

In accordance with an aspect of the present disclosure, a power socket is provided. The power socket includes a main body and at least one latch member. The main body includes at least one connection seat, at least one receiving recess and at least one latching slot in communication with the receiving recess. The connection seat is disposed within the receiving recess and configured to electrically connect with a power plug, when the power plug is fitted in the receiving recess along a first direction. The at least one latch member includes at least one arm slidable along the latching slot from a first position to a second position along a second direction. The arm includes at least one protrusion configured to slide into the receiving recess for engaging with a lateral wall of the power plug when the arm slides towards the second position.

In an embodiment, when the arm moves towards the first position, the at least one protrusion of the arm is configured to move away from the receiving recess.

In an embodiment, the at least one latching slot extends along the second direction inwardly from a first outer wall of the main body.

In an embodiment, the at least one protrusion protrudes laterally from a side of the arm such that the protrusion protrudes toward the receiving recess when the arm is in the second position.

In an embodiment, the at least one latching slot includes a first latching slot and a second latching slot disposed on two opposite sides of the receiving recess of the main body, respectively, wherein the first latching slot and the second latching slot extends along the second direction inwardly from a first outer wall of the main body, wherein the at least one arm of the latch member includes a first arm slidable along the first latching slot and a second arm slidable along the second latching slot, wherein the first arm comprises a first protrusion and a second protrusion, each protruding laterally from a side of the first arm such that the first protrusion and the second protrusion protrudes toward the receiving recess when the first arm is in the second position, wherein the second arm comprises a third protrusion and a fourth protrusion, each protruding laterally from a side of the second arm so that the third protrusion and the fourth protrusion protrudes toward the receiving recess when the second arm is in the second position, wherein when the power plug is fitted in the receiving recess along the first direction for electrically connecting with the connection seat, and the first arm and the second arm are operated to slide from the first position towards the second position along the second direction, the first protrusion and the second protrusion are caused to slide into the receiving recess and abut against a first lateral wall of the power plug, and the third protrusion and the fourth protrusion are caused to slide into the receiving recess and abut against a second lateral wall of the power plug.

In an embodiment, the power plug comprises four lateral walls, the first lateral wall and the second lateral wall includes two opposite lateral walls being located on opposite sides of the power plug, and a third lateral wall and a fourth lateral wall being located on opposite sides of the power plug, wherein the lengths of the first lateral wall and the second lateral wall are longer than the lengths of the third lateral wall and the fourth lateral wall of the power plug.

In an embodiment, the length of the first lateral wall is shorter than the length of the second lateral wall, and the distance between the first protrusion and the second protrusion is shorter than the distance between the third protrusion and the fourth protrusion.

In an embodiment, when the power plug is fitted in the receiving recess and the first arm and the second arm are in the second position, a force vector generated by the first protrusion abutting against the first lateral wall and a force vector generated by the second protrusion abutting against the first lateral wall are antiparallel to a force vector generated by the third protrusion abutting against the second lateral wall and a force vector generated by the fourth protrusion abutting against the second lateral wall, and crossed to a connection line between the third protrusion and the fourth protrusion.

In an embodiment, when the first arm and the second arm move toward the first position, the first protrusion and the second protrusion of the first arm and the third protrusion and the fourth protrusion of the second arm are effected to move away from the receiving recess.

In an embodiment, when the first arm and the second arm move toward the first position, the first protrusion and the second protrusion of the first arm are moved away from the first latching slot, and the third protrusion and the fourth protrusion of the second arm are effected to move away from the second latching slot.

In an embodiment, the latch member includes a connection part disposed between the first arm and the second arm, wherein when the first arm and the second arm are at the first position, the connection part is configured to engage with the first outer wall of the main body.

In an embodiment, the latch member comprises a holding part disposed between the first arm and the second arm, wherein the holding part is operable to slide the first arm and the second arm along the first latching slot and the second latching slot, respectively.

In an embodiment, the holding part includes an opening for insertion of a finger to operate a movement of the first arm and the second arm.

In an embodiment, the latch member comprises metal material.

In an embodiment, the latch member includes a holding part connected to one end of the at least one arm, and wherein the holding part is configured to be held by a user to control the at least one arm to slide along the at least one latching slot.

In an embodiment, the holding part includes an opening for allowing insertion of a finger of the user to pass through to control the at least one arm to slide along the at least one latching slot.

In an embodiment, the latch member includes a stop part disposed at an end opposite to the holding part, and wherein when the at least one arm is moved from the second position towards the first position, the stop part is configured to obstruct the latch member from being detached from the main body.

In an embodiment, the at least one latching slot extends along the second direction inwardly from a first outer wall of the main body towards a second outer wall of the main body, and wherein the first outer wall and the second outer wall are opposite to each other and the holding part and the stop part are adjacent to the first outer wall and the second outer wall of the main body, respectively.

In an embodiment, the stop part comprises a barb, a hook, or a protruded stopper.

In an embodiment, the holding part includes a finger ring.

The above contents of the present disclosure will become more readily apparent to those ordinarily skilled in the art after reviewing the following detailed description and accompanying drawings, in which:

DESCRIPTION OF THE EMBODIMENTS

The present disclosure will now be described more specifically with reference to the drawings. It is to be noted that the following descriptions of embodiments of this disclosure are presented herein is not intended to be exhaustive or to be limited to the precise form disclosed.

Figure 1:
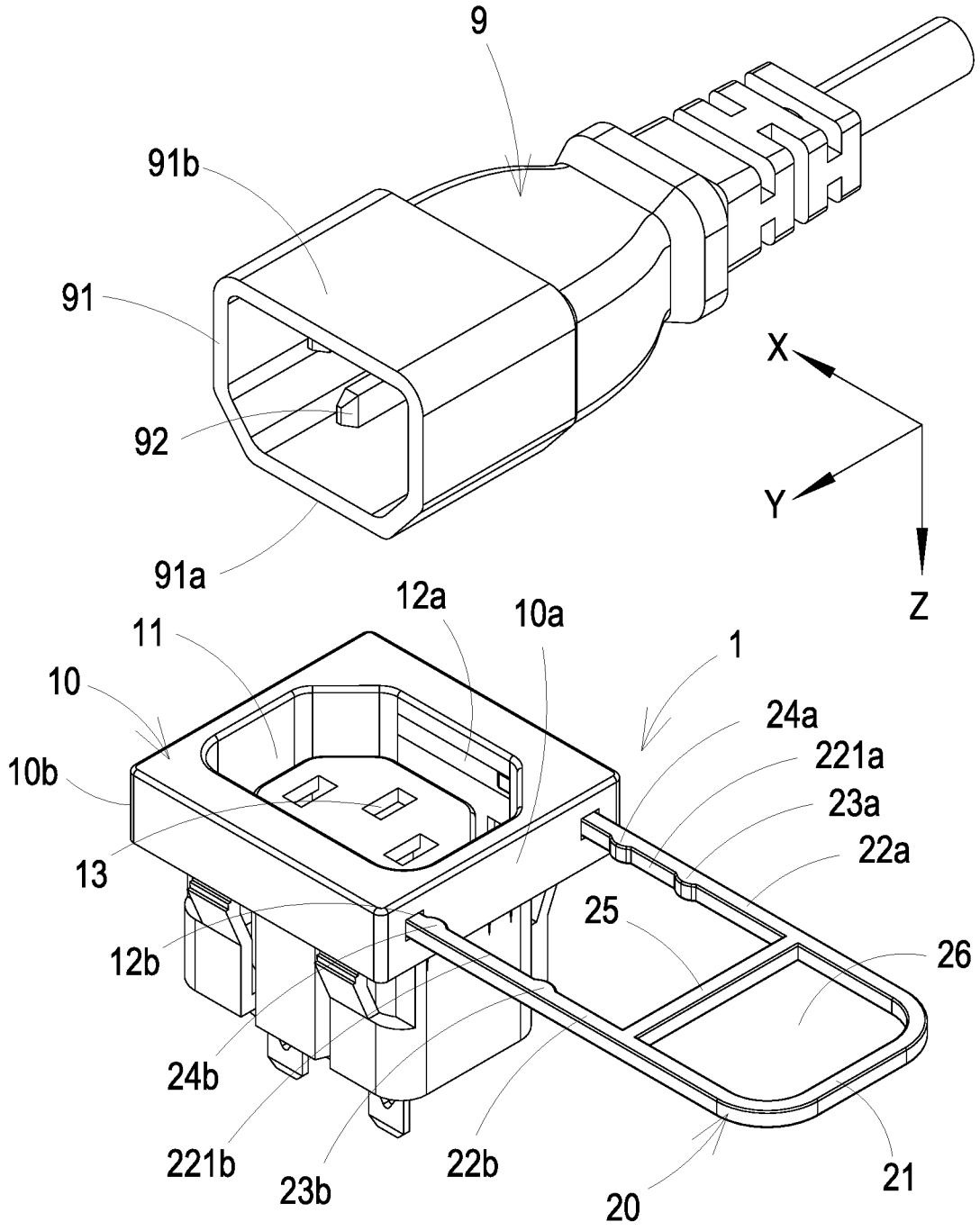
FIG. 1 is a schematic structural view illustrating a power socket and a power plug applied thereto according to a first embodiment of the present disclosure.
Figure 2:
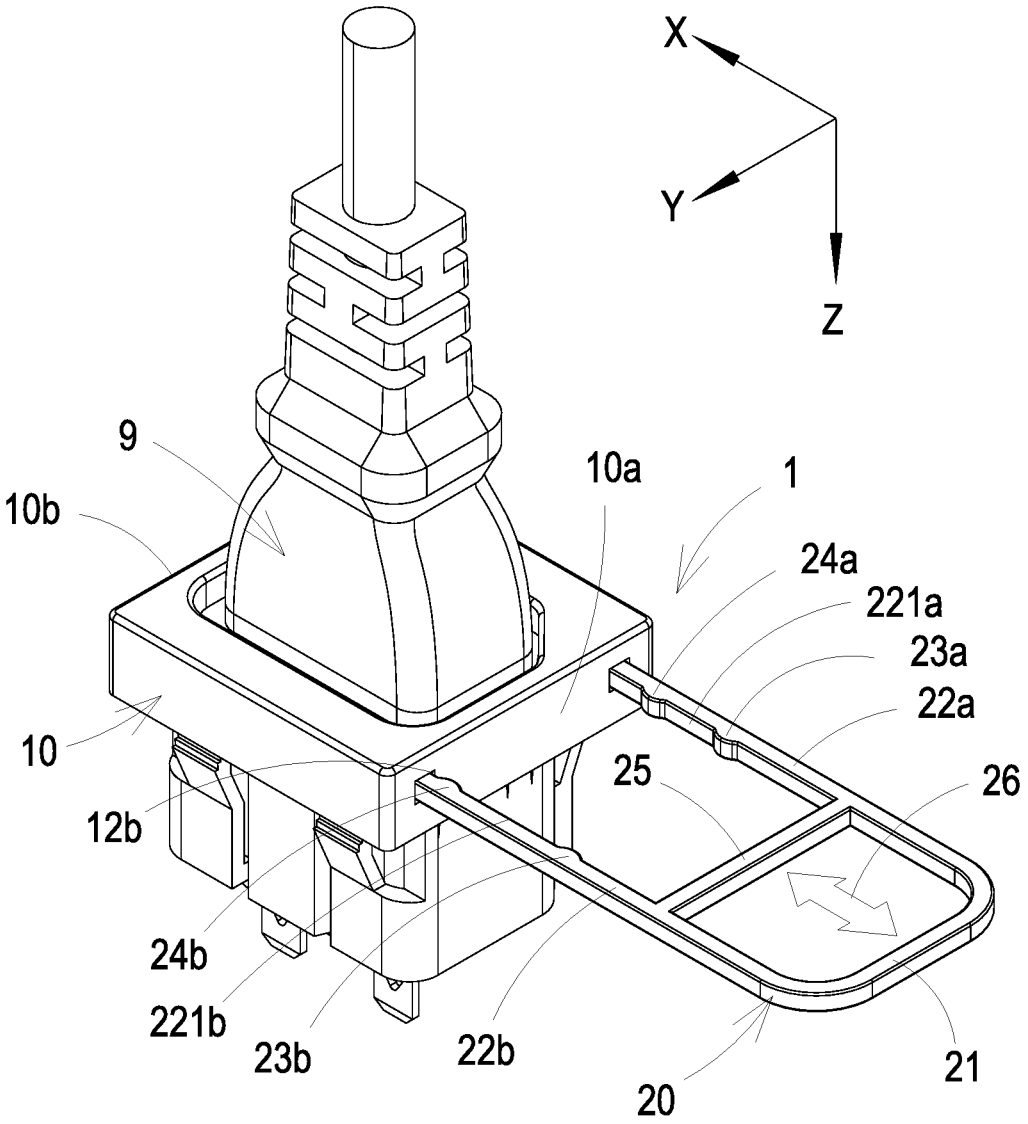
FIG. 2 is a schematic structural view illustrating the power socket of FIG. 1 set in a first position.
Figure 3:
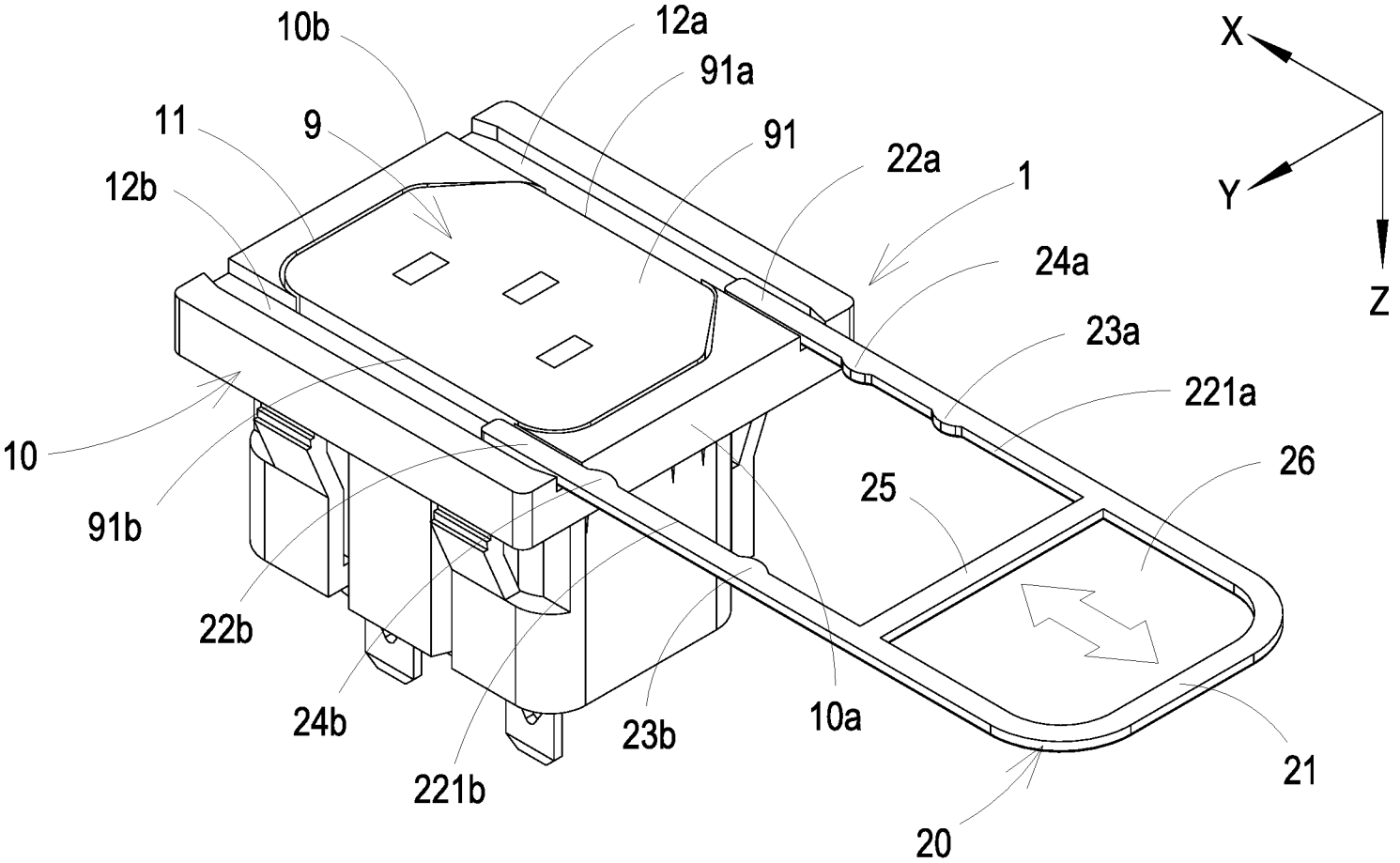
FIG. 3 is a partial cross-sectional view illustrating the power socket of FIG. 2.
Figure 4:
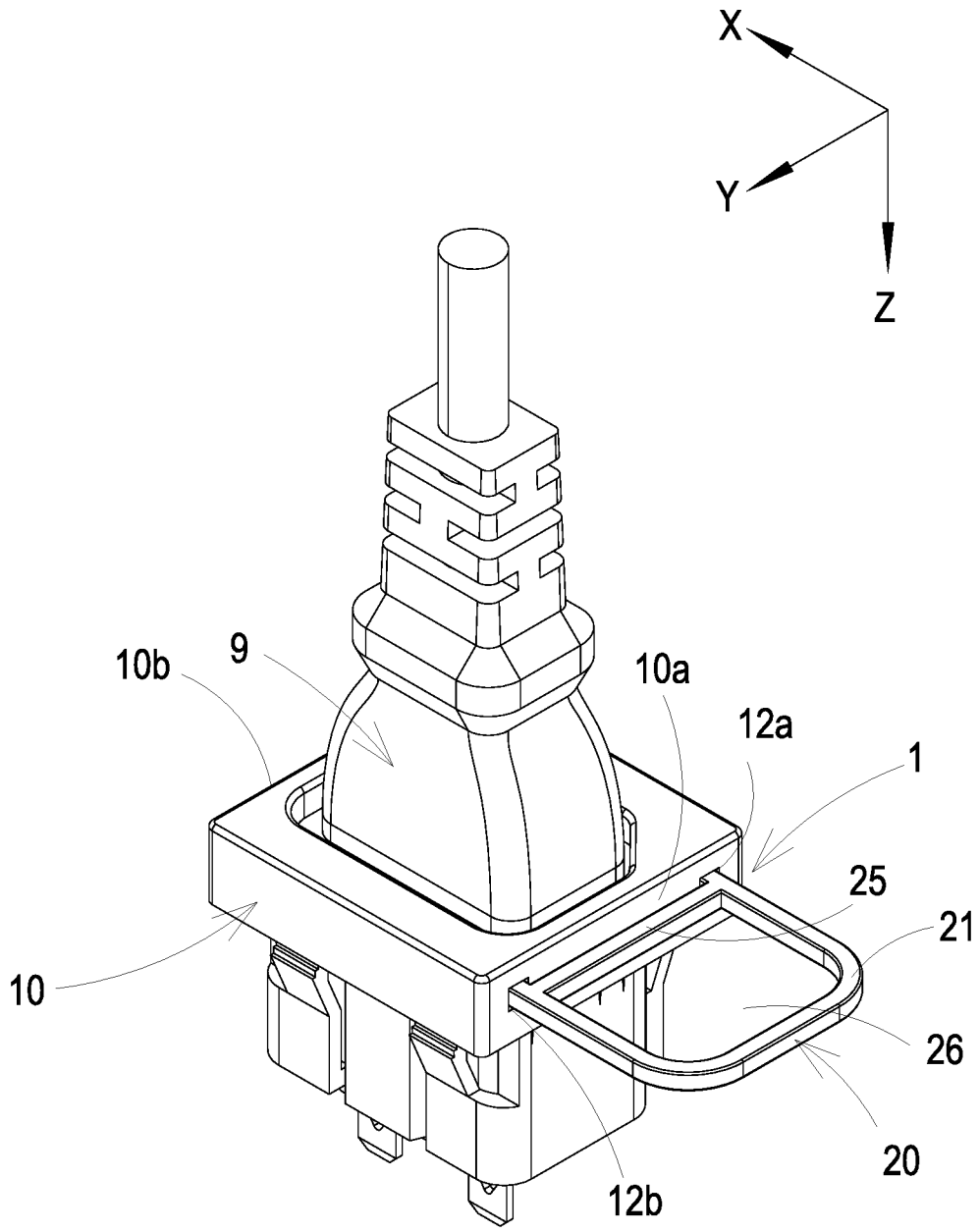
FIG. 4 is a schematic structural view illustrating the power socket of FIG. 1 set in a second position.
Figure 5:
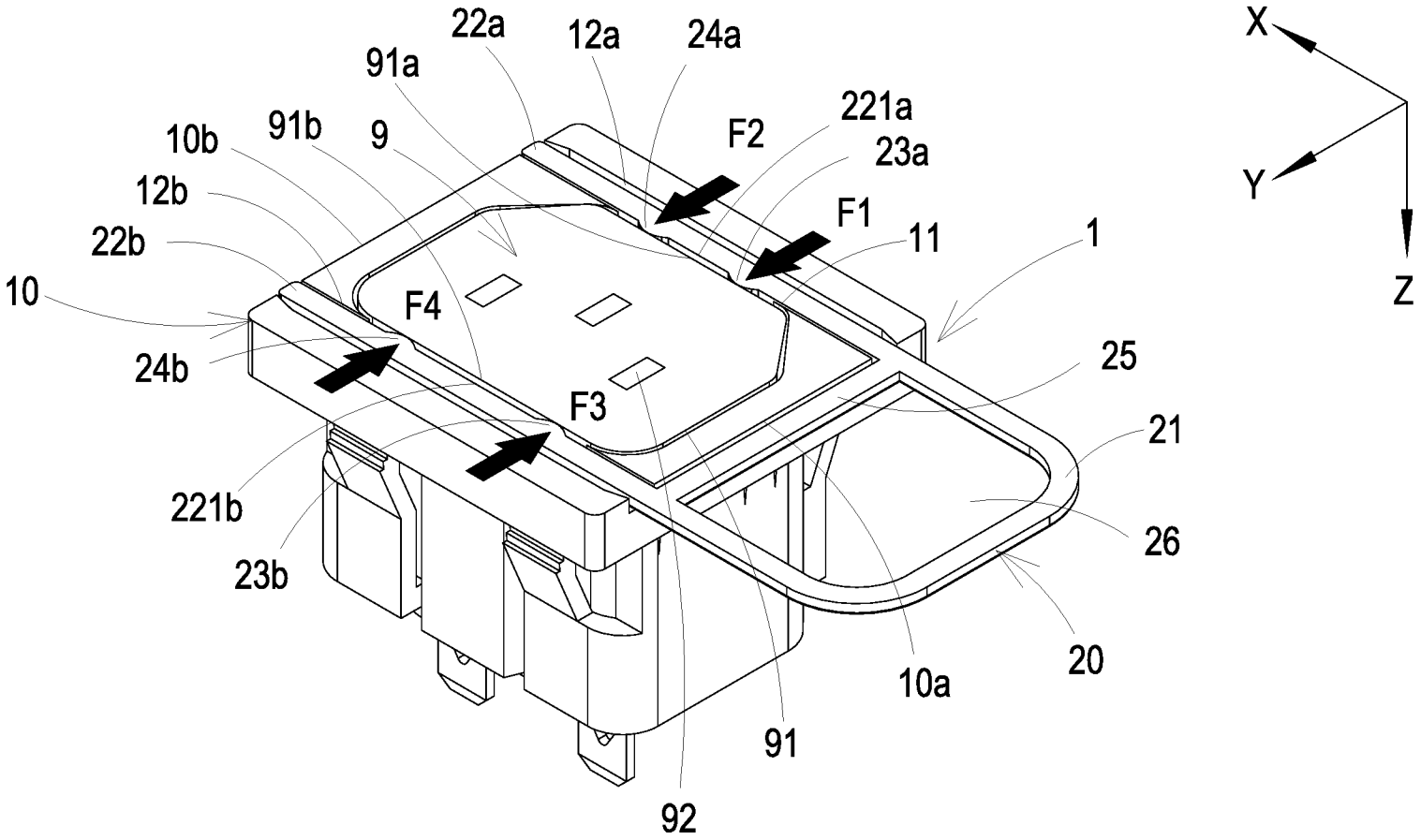
FIG. 5 is a partial cross-sectional view illustrating the power socket of FIG. 4.

Referring to FIGS. 1 to 5, according to the embodiment shown, the power socket 1 includes a main body 10 and at least one latch member 20. The main body 10 includes at least one connection seat 13, at least one receiving recess 11 and at least one latching slot 12*a*, 12*b*. The connection seat 13 is a standard terminal connection seat and disposed within the receiving recess 11. In the embodiment, the connection seat 13 is configured to engage and electrically connect with a power plug 9, which is fitted in the receiving recess 11 along a first direction, for example along a Z-axis direction. The at least one latching slot 12*a*, 12*b* is extended inwardly along a second direction, for example along an X-axis direction, from a first outer wall 10*a* of the main body 10 and in communication with the receiving recess 11. In the embodiment, the at least one latching slot 12*a*, 12*b* further extends through the first outer wall 10*a* and the second outer wall 10*b* of the main body 10. The first outer wall 10*a* and the second outer wall 10*b* are opposite to each other. Furthermore, the at least one latch member 20 includes at least one arm 22*a*, 22*b* slidable along the latching slot 12*a*, 12*b*. The arm 22*a* includes at least one protrusion 23*a*, 24*a* and the arm 22*b* includes at least one protrusion 23*b*, 24*b*. While the power plug 9 is fitted in the receiving recess 11 along the first direction (i.e. the Z-axis direction) and electrically connected with the connection seat 13 and the arm 22*a*, 22*b* slides from a first position (as shown in FIGS. 2 and 3) to a second position (as shown in FIGS. 4 and 5) along the second direction (i.e. the X-axis direction), the at least one protrusion 23*a*, 24*a*, 23*b*, 24*b* is configured to slide into the receiving recess 11 to abut against a lateral wall 91*a*,

91*b* of the power plug 9, so as to fasten the power plug 9 on the main body 10. Namely, while the arm 22*a*, 22*b* is located at the first position, as shown in FIGS. 2 and 3, the at least one protrusion 23*a*, 24*a* of the arm 22*a* and the at least one protrusion 23*b*, 24*b* of the arm 22*b* are moved away from the receiving recess 11, respectively, so as to facilitate the power plug 9 to insert into the receiving recess 11 and engage with the connection seat 13 for electrical connection or to be separated from the connection seat 13.

In the embodiment, the main body 10 of the power socket 1 includes a first latching slot 12*a* and a second latching slot 12*b* disposed on two opposite sides of the receiving recess 11, respectively, extending inwardly along the second direction (i.e. the X-axis direction) from the first outer wall 10*a* of the main body 10 and in communication with the receiving recess 10. In the embodiment, the first latching slot 12*a* and the second latching slot 12*b* further extends through the second outer wall 10*b*, which is opposite to the first outer wall 10*a*. In addition, the latch member 20 includes a first arm 22*a* and a second arm 22*b*, which slide along the first latching slot 12*a* and the second latching slot 12*b*, respectively. In the embodiment, the first arm 22*a* includes a first protrusion 23*a* and a second protrusion 24*a*. The first protrusion 23*a* protrudes from a side 221*a* of the first arm 22*a* towards the receiving recess 11, and the second protrusion 24*a* protrudes from the side 221*a* of the first arm 22*a* towards the receiving recess 11. The second arm 22*b* includes a third protrusion 23*b* and a fourth protrusion 24*b*. The third protrusion 23*b* protrudes from a side 221*b* of the second arm 22*b* towards the receiving recess 11, and the fourth protrusion 24*b* protrudes from the side 221*b* of the second arm 22*b* towards the receiving recess 11. While the power plug 9 is fitted in the receiving recess 11 along the first direction (i.e. the Z-axis direction) and electrically connected with the connection seat 13 and the first arm 22*a* and the second arm 22*b* slides from the first position (as shown in FIGS. 2 and 3) to the second position (as shown in FIGS. 4 and 5) along the second direction (i.e. the X-axis direction), respectively, the first protrusion 23*a* and the second protrusion 24*a* of the first arm 22*a* are configured to slide into the receiving recess 11 to abut against a first lateral wall 91*a* of the power plug 9 along for example a Y-axis direction, and the third protrusion 23*b* and the fourth protrusion 24*b* of the second arm 22*b* are configured to slide into the receiving recess 11 to abut against a second lateral wall 91*b* of the power plug 9 along for example a reversed Y-axis direction. Consequently, the power plug 9 is fastened on the main body 10 of the power socket 1.

In an embodiment, the main body 10 has the same frame structure as the standard socket, and the structure of the first latching slot 12*a* and the second latching slot 12*b* can be formed on the body 10 by a perforation technique, an injection molding or other forming techniques, and be in communication with the receiving recess 11 for receiving correspondingly the at least one latch member 20. By using a non-complex operation method to move the latch member 20 between the first position and the second position, the retaining force between the power socket 1 and the power plug 9 can be enhanced. It is noted that the power socket 1 is applicable to a general standard plug, and the overall structure does not need to be designed to match with a special specification and an external power plug, thereby effectively improving the structural reliability of the power socket 1.

In the embodiment, the power plug 9 includes four lateral walls and the first lateral wall 91*a* and the second lateral wall 91*b* can be for example two opposite lateral walls of the power plug 9. The power plug 9 further includes a third wall and a fourth lateral wall (not shown) being located on opposite sides of the power plug 9. Each one of the first lateral wall 91*a* and the second lateral wall 91*b* is wider than each one of the third lateral wall and the fourth lateral wall of the power plug 9, so that the power plug 9 can be fastened on the main body 10 of the power socket 1 firmly by using the latch member 20. In the embodiment, the power plug 9 can be for example an IEC60320 standard power plug. The length of the first lateral wall 91*a* can be shorter than the length of the second lateral wall 91*b*. The receiving recess 11 has a profile identical to the outer wall 91 of the plug 9. For the configuration of which the length of the first lateral wall 91*a* is shorter than the length of the second lateral wall 91*b* of the power plug 9, the distance between the first protrusion 23*a* and the second protrusion 24*a* of the first arm 22*a* is shorter than the distance between the third protrusion 23*b* and the fourth protrusion 24*b* of the second arm 22*b*. Thus, the embodiment facilitates the latch member 20 to fasten the power plug 9 on the main body 10 of the power socket 1 firmly. In other words, while the power plug 9 is fitted in the receiving recess 11 along the first direction (i.e. the Z-axis direction) and electrically connected with the connection seat 13 and the first arm 22*a* and the second arm 22*b* are moved from the first position (as shown in FIGS. 2 and 3) to the second position (as shown in FIGS. 4 and 5) along the second direction (i.e. the X-axis direction), respectively, the first arm 22*a* slides along the first latching slot 12*a* and the second arm 22*b* slides along the second latching slot 12*b*. Consequently, the first protrusion 23*a* and the second protrusion 24*a* abut against the first lateral wall 91*a* of the power plug 9, and the third protrusion 23*b* and the fourth protrusion 24*b* abut against the second lateral wall 91*b* of the power plug 9. Thus, the power plug 9 is fastened on the main body 10 of the power socket 1.

It is noted that a force vector F1 generated by the first protrusion 23*a* abutting against the first lateral wall 91*a* and a force vector F2 generated by the second protrusion 24*a* abutting against the first lateral wall 91*a* cooperates with a force vector F3 generated by the third protrusion 23*b* abutting against the second lateral wall 91*b* and a force vector F4 generated by the fourth protrusion 24*b* abutting against the second lateral wall 91*b*, as shown in FIG. 5. In this way, the first protrusion 23*a*, the second protrusion 24*a*, the third protrusion 23*b* and the fourth protrusion 24*b* are arranged in the shape of a trapezoid such that each one of the first protrusion 23*a*, the second protrusion 24*a*, the third protrusion 23*b* and the fourth protrusion 24*b* is located at one corner of the trapezoid. In the embodiment, the first protrusion 23*a* and the second protrusion 24*a* of the first arm 22*a* and the third protrusion 23*b* and the fourth protrusion 24*b* of the second arm 22*b* are arranged in two base edges of an isosceles trapezoid. The first protrusion 23*a* and the second protrusion 24*a* are arranged on the shorter base edge. The third protrusion 23*b* and the fourth protrusion 24*b* are arranged on the longer base edge. The present disclosure is not limited thereto. Moreover, although the first lateral wall 91*a* and the second lateral wall 91*b* of the power plug 9 may not be equal in length, the latch member 20 can implement the distribution of the force vectors F1, F2, F3 and F4 by configuring the arrangement and locations of the first protrusion 23*a*, the second protrusion 24*a*, the third protrusion 23*b* and the fourth protrusion 24*b*, so as to provide an optimized torque balance. It is noted that the number of, the distribution position and the relative relationship of the arms and the protrusions of the latch member 20 are configurable according to practical requirements, and the present disclosure is not limited thereto.

On the other hand, as shown in FIGS. 2 and 3, while the first arm 22*a* and the second arm 22*b* of the latch member 20 are located at the first position, the first protrusion 23*a* and the second protrusion 24*a* of the first arm 22*a* are moved away from the first latching slot 12*a* and the receiving recess 11, and the third protrusion 23*b* and the fourth protrusion 24*b* of the second arm 22*b* are moved away from the second latching slot 12*b* and the receiving recess 11. Thus, this configuration facilitates the power plug 9 to be separated from the connection seat 13 through the receiving recess 11. In other embodiments, the first arm 22*a* and the second arm 22*b* of the latch member 20 can be completely separated from the first latching slot 12*a* and the second latching slot 12*b*, respectively, to separate the latch member 20 from the main body 10. Thus, this allows the latch member 20 to be replaced. Alternatively, the first arm 22*a* and the second arm 22*b* of the latch member 20 can be re-inserted into the first latching slot 12*a* and the second latching slot 12*b*, respectively, through the second outer wall 10*b* located opposite to the first outer wall 10*a*.

The latch member 20 may be made of metal material having sufficient mechanical strength to abut against the power plug 9, and to avoid the damage due to friction with the power plug 9 under long-term operating conditions. However, the present disclosure is not limited to this and other suitable materials which has sufficient mechanical and resilience qualities for use are also envisaged. In addition, the latch member 20 further includes a connection part 25 bridging between the first arm 22*a* and the second arm 22*b*. While the first arm 22*a* and the second arm 22*b* slide from the first position to the second position along the second direction (i.e. the X-axis direction), the connection part 25 is configured to contact the first outer wall 10*a* of the main body 10. The latch member 20 further includes a holding part 21 bridging between the ends of the first arm 22*a* and the second arm 22*b* and configured to be held by a user to control the first arm 22*a* and the second arm 22*b* to slide along the first latching slot 12*a* and the second latching slot 12*b*, respectively. The holding part 21 can be for example a finger ring. The holding part 21 may include an opening 26 formed with connection part 25, and the user can utilize a finger to pass through the opening 26 and grab the holding part 21 so as to control the first arm 22*a* and the second arm 22*b* to slide along the first latching slot 12*a* and the second latching slot 12*b*, respectively. This facilitates the movement of the latch member 20 between the first position and the second position.

Figure 6:
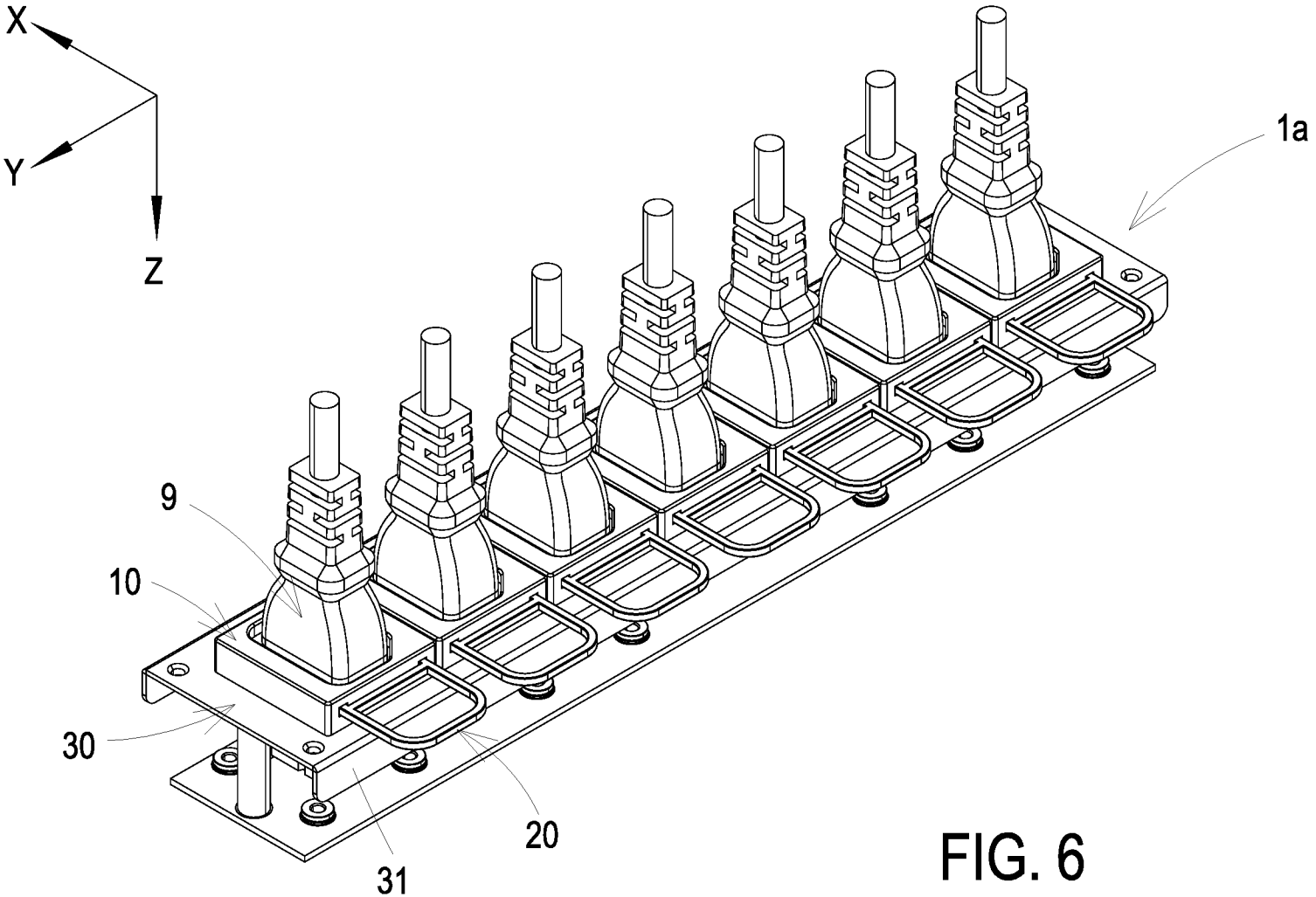
FIG. 6 is a schematic structural view illustrating a power socket and plural power plugs applied thereto according to a second embodiment of the present disclosure.
Figure 7:
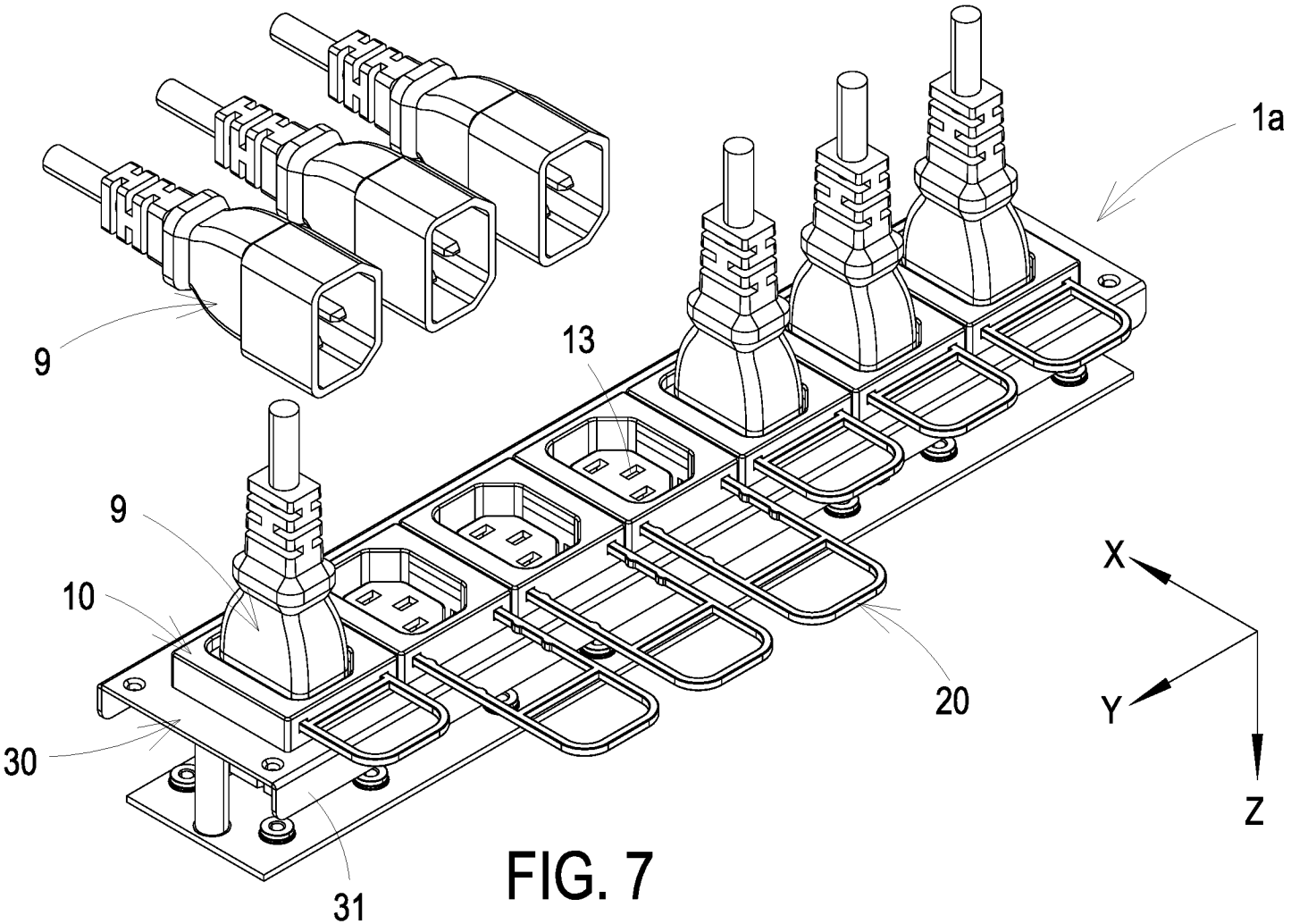
FIG. 7 is a schematic structural view illustrating the power socket of FIG. 6, wherein some power plugs are separated from the power socket.
Figure 8:
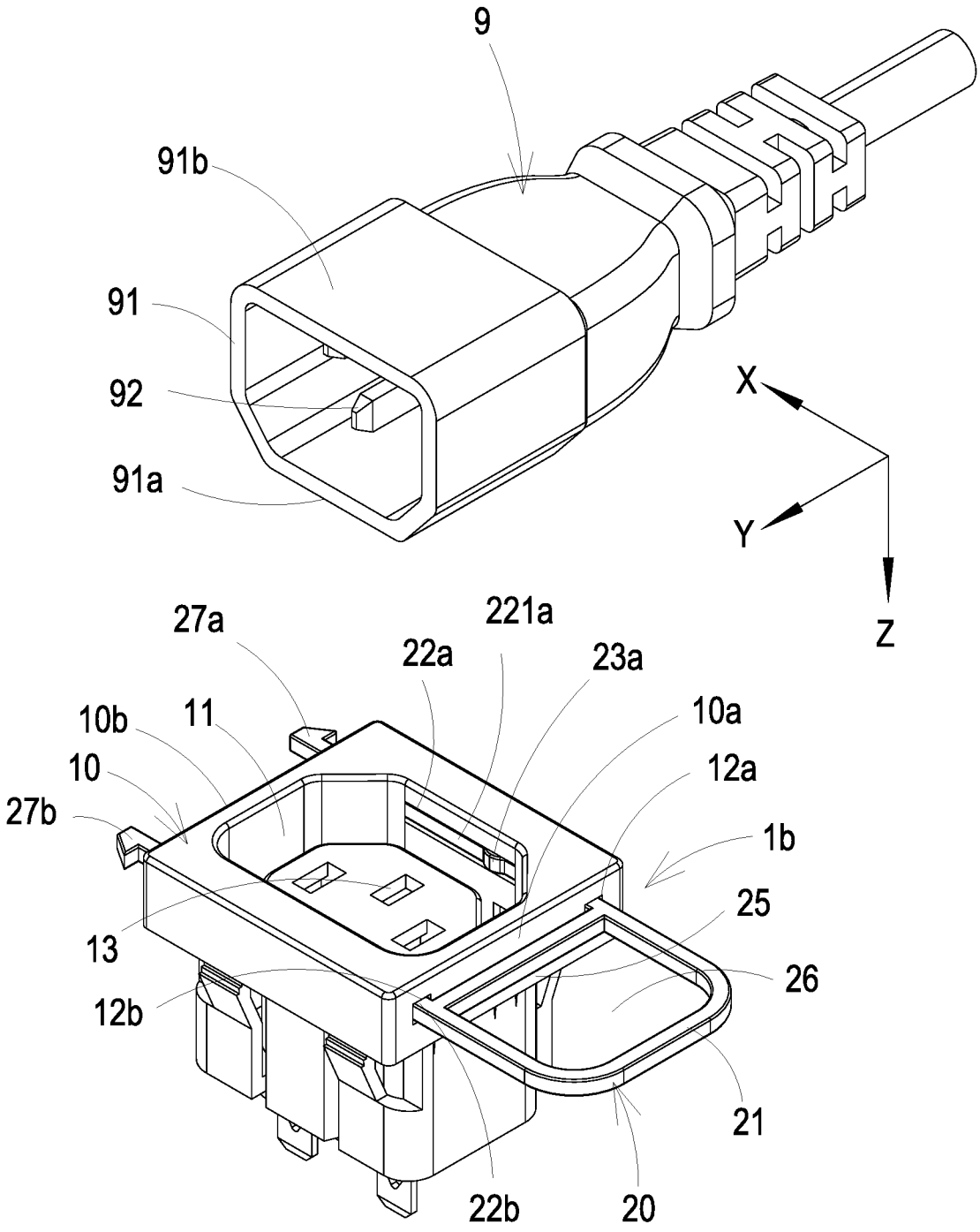
FIG. 8 is a schematic structural view illustrating a power socket and a power plug applied thereto according to a third embodiment of the present disclosure.
Figure 9:
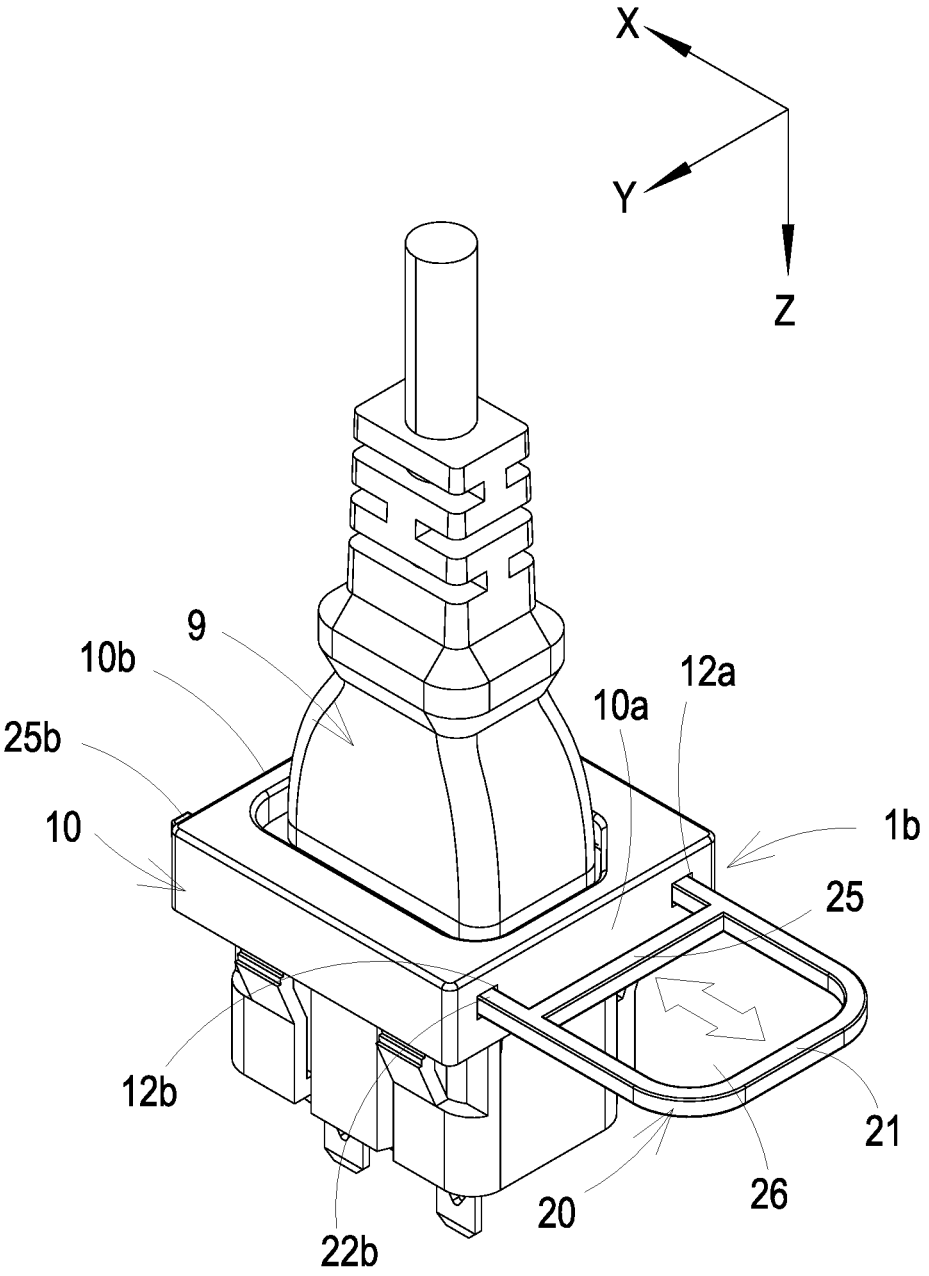
FIG. 9 is a schematic structural view illustrating the power socket of FIG. 8 set in a first position.
Figure 10:
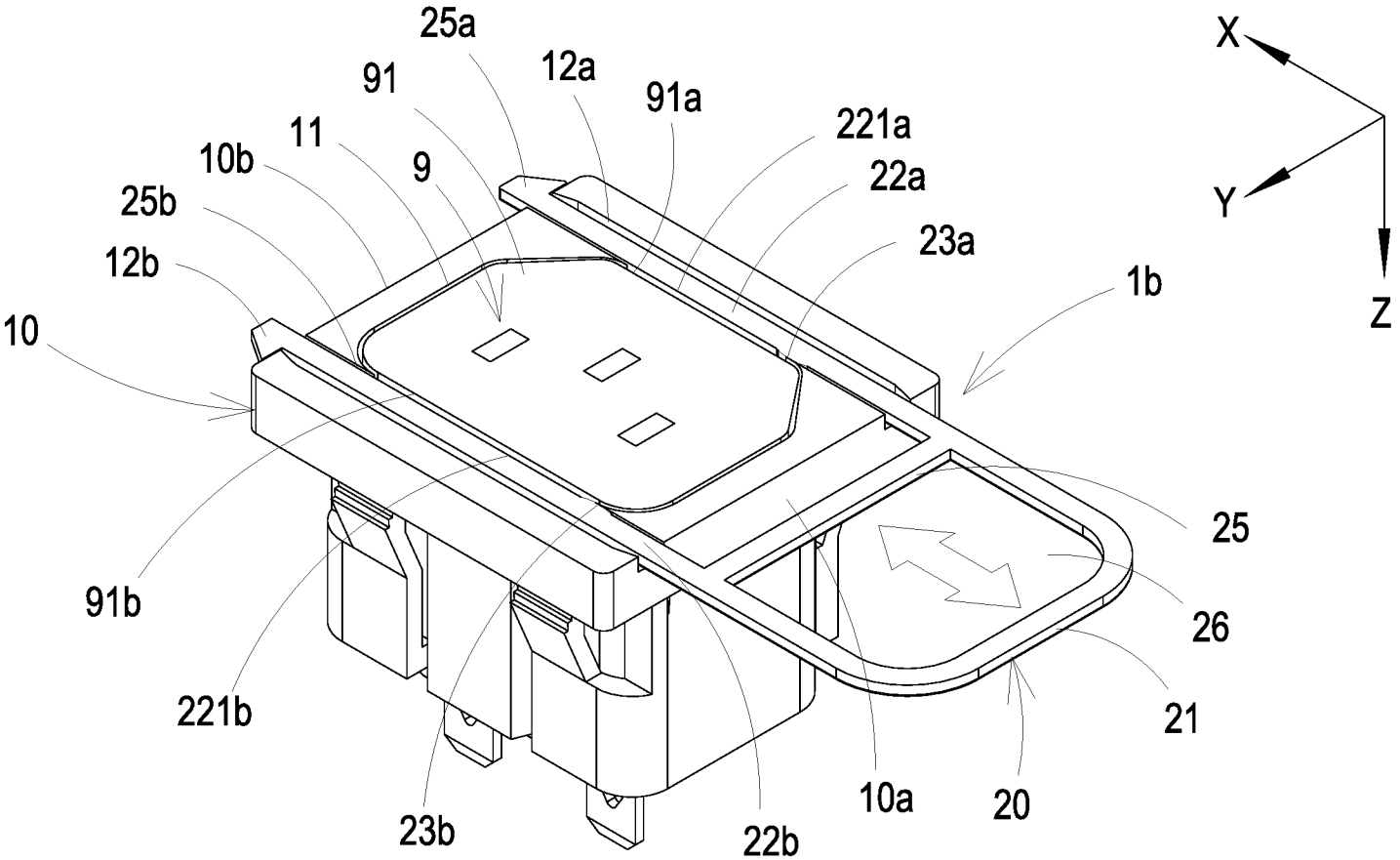
FIG. 10 is a partial cross-sectional view illustrating the power socket of FIG. 9.
Figure 11:
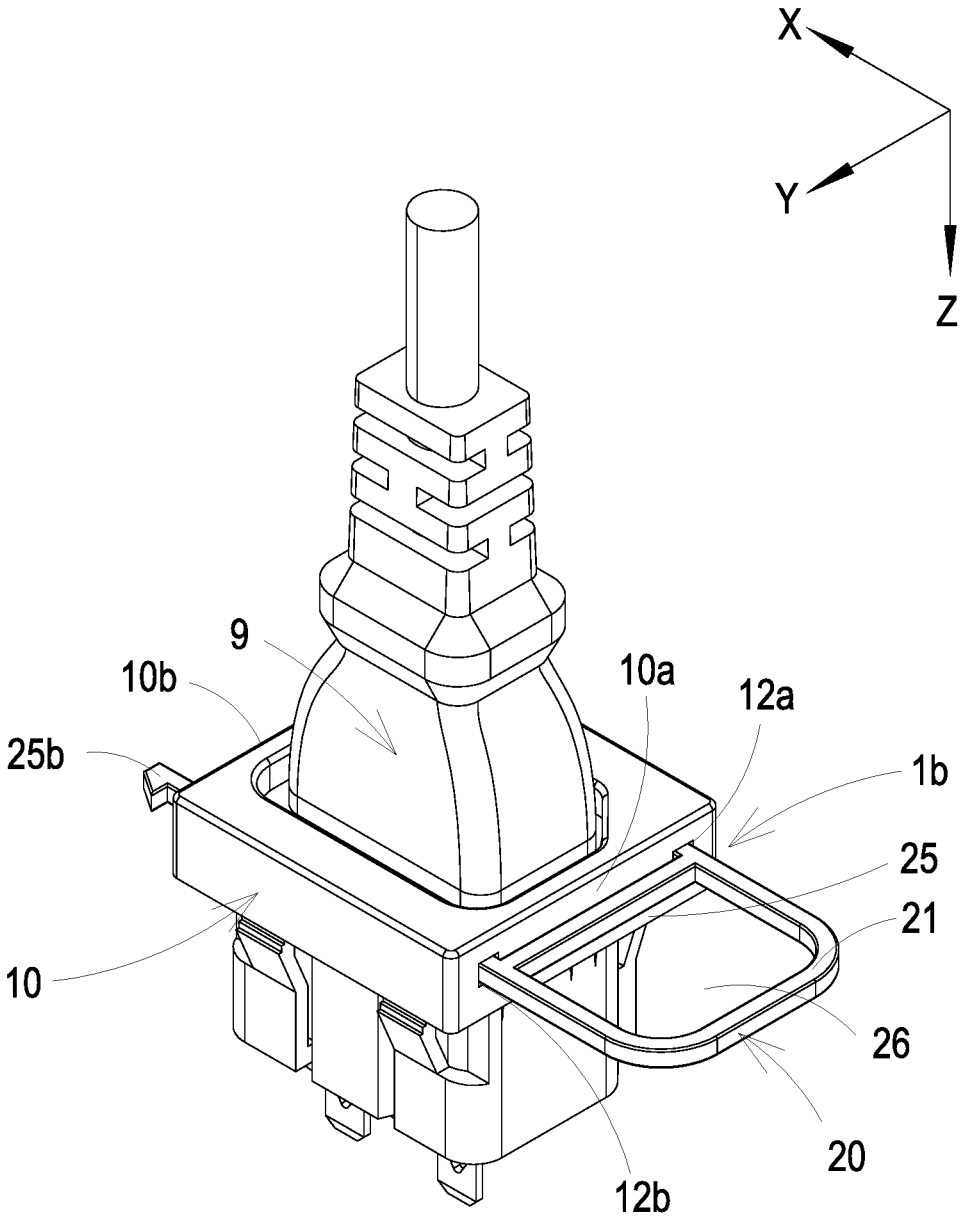
FIG. 11 is a schematic structural view illustrating the power socket of FIG. 8 set in a second position.

FIG. 6 is a schematic structural view illustrating a power socket and plural power plugs applied thereto according to a second embodiment of the present disclosure. FIG. 7 is a schematic structural view illustrating the power socket of FIG. 6, wherein some power plugs are separated from the power socket. For the embodiment shown, the structures, elements and functions of the power socket 1*a* and the power plugs 9 are similar to those of the power socket 1 and the power plug 9 in FIGS. 1 to 5, and are not redundantly described herein. In the embodiment, the power socket 1*a* can be, for example, a power socket in a cabinet, which can be applied to meet with the power plugs 9 of the server and storage system in the rack. The power socket 1*a* includes plural main bodies 10, plural latch members 20 and a base 30. The plural main bodies 10 are regularly arranged and fixed on the base 30. The corresponding relationship between the main body 10 and the latch member 20 in each set is similar to the foregoing embodiment, and is not redundantly described herein. In the embodiment, the plural main bodies 10 are disposed on the base 30 in a regular arrangement, and the plural latch members 20 are disposed on the base 30 and adjacent to an identical side 31 of the base 30. As shown in FIG. 6, in the embodiment, for example, seven sets of the main bodies 10 and the latch members 20 are utilized to fasten seven power plugs 9 on the power socket 1*a*. Namely, while each power plug 9 is electrically connected with the corresponding connection seat 13 and the first arm 22*a* and the second arm 22*b* of the corresponding latch member 20 are slid to the second position (referring to FIGS. 4 and 5), respectively, the plural power plugs 9 are fastened on the power socket 1*a* neatly and firmly. Alternatively, in another use scenario as shown in FIG. 7, while a part of the plural power plugs 9, for example three power plugs 9 arranged sequentially on the power socket 1*a*, have to be removed or replaced from the power socket 1*a*, the user can pull the corresponding latch members 20 by the fingers of one hand passing through the openings 26 of the corresponding holding parts 21 to slide the first arm 22*a* and the second arm 22*b* of the corresponding latch members 20 to the first position (referring to FIGS. 2 and 3). Thus, the power plugs 9 can be removed and separated from the corresponding connection seats 13 of the power socket 1*a*, or replaced to reinsert on the power socket 1*a*. It is noted that any set of the latch member 20 and the main body 10 can be operated to plug in/out and fasten/unfasten without the interference from the other combinations of the latch members 20 and the main bodies 10. The switching operation to change the position of the latch member 20 is not affected by the arrangement of the other main bodies 10 and the latch members 20, and can be accomplished by one hand of the user. The arrangement of the main bodies 10 and the latch members 20 disposed on the base 30 is not limited to the foregoing embodiment, and is not redundantly described herein. By utilizing the combination of the main body 10 and the latch member 20 of the power socket 1*a*, it facilitates the power socket 1*a* to achieve the switching operation of latching mode (i.e. the use state at the second position) or unlatching mode (i.e. the use state at the first position) by a simple manual push-pull operation with one hand. Thus, the retaining force between the power socket 1*a* and the power plug 9 can be enhanced effectively and the convenience of its operation can be effectively improved. At the same time, it prevents the power plugs 9 of the server and storage system in the rack and the power socket 1*a* of the PDU from loosening caused by the human or other unintended conditions.

Referring to FIG. 8 to FIG. 12, in the embodiment shown, the structures, elements and functions of the power socket 1*b* and the power plug 9 are similar to those of the power socket 1 and the power plug 9 in FIGS. 1 to 5, and are not redundantly described herein. In the embodiment, the main body 10 of the power socket 1*b* includes a first latching slot 12*a* and a second latching slot 12*b*, which are disposed on two opposite sides of the receiving recess 11, respectively, extend inwardly along the second direction (i.e. the X-axis direction) and pass through the first outer wall 10*a* and the second outer wall 10*b* of the main body 10. The first latching slot 12*a* and the second latching slot 12*b* are in communication with the receiving recess 11. In addition, the latch member 20 includes a first arm 22*a* and a second arm 22*b*, which slide along the first latching slot 12*a* and the second latching slot 12*b*, respectively. In the embodiment, the first arm 22*a* includes a first protrusion 23*a* protruding from a side 221*a* of the first arm 22*a* toward the receiving recess 11, and the second arm 22*b* includes a third protrusion 23*b* protruding from a side 221*b* of the second arm 22*b* toward the receiving recess 11. The latch member 20 further includes a connection part 25 connected with the first end portions of the first arm 22*a* and the second arm 22*b*, respectively, and a holding part 21 connected with the first arm 22*a* and the second arm 22*b* and also the connection part 25. Moreover, the latch member 20 further includes at least one stop part 27*a*, 27*b*, which can be for example (but not limited to) a barb or hook or a protruded stopper, corresponding to the holding part 21 and the connection part 25, and connected to the second end portions of the first arm 22*a* and the second arm 22*b*. In other words, the holding part 21 is disposed adjacent to the first outer wall 10*a* of the main body 10 and the stop parts 27*a*, 27*b* are disposed adjacent to the second outer wall 10*b* of the main body 10. Thus, it facilitates the first arm 22*a* and the second arm 22*b* to be slid along the first latching slot 12*a* and the second latching slot 12*b*, respectively, so as to achieve the switching operation between the first position and the second position. For example, when the latch member 20 is located at the first position, the connection part 25 and the holding part 21 are moved away from the first outer wall 10*a* of the main body 10, and the stop parts 27*a*, 27*b* are moved towards the second outer wall 10*b* of the main body 10 and may abut against the second outer wall 10*b* to stop the latch member 20 being detached from the main body 10. When the latch member 20 is reconfigured to the second position, the connection part 25 and the holding part 21 are moved towards to the first outer wall 10*a* of the main body 10, and the stop parts 27*a*, 27*b* are moved away from the second outer wall 10*b* of the main body 10. In other embodiments, the stop part 27*a* of the first arm 22*a* and the stop part 27*b* of the second arm 22*b* are connected with each other to form a connected structure, but not limited thereto and not redundantly described herein.

Figure 12:
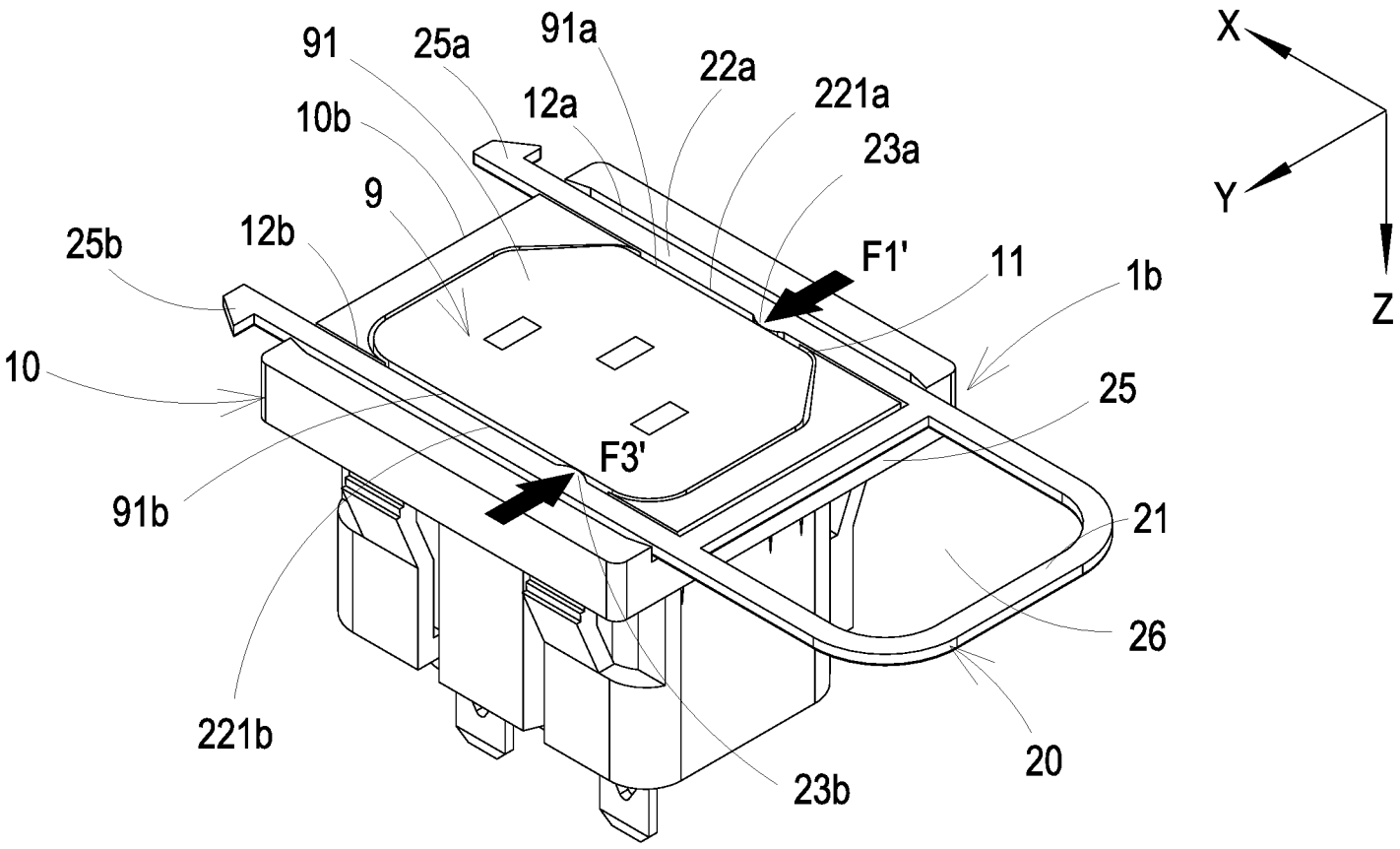
FIG. 12 is a partial cross-sectional view illustrating the power socket of FIG. 11.

As shown in FIG. 12, in the embodiment, a force vector F1' generated by the first protrusion 23*a* abutting against the first lateral wall 91*a* of the power plug 9 and a force vector F3' generated by the third protrusion 23*b* abutting against the second lateral wall 91*b* of the power plug 9 are not aligned with each other. In this way, although the first lateral wall 91*a* and the second lateral wall 91*b* of the power plug 9 are not equal in length, the latch member 20 can still distribute the force vectors F1' and F3' by configuring the arrangement and locations of the first protrusion 23*a* and the third protrusion 23*b*, so as to provide a sufficient friction for fastening the power plug 9. Certainly, the number, the distribution position and the relative relationship of the arms and the protrusions of the latch member 20 are configurable according to the practical requirements, and the present disclosure is not limited thereto.

Figure 13:
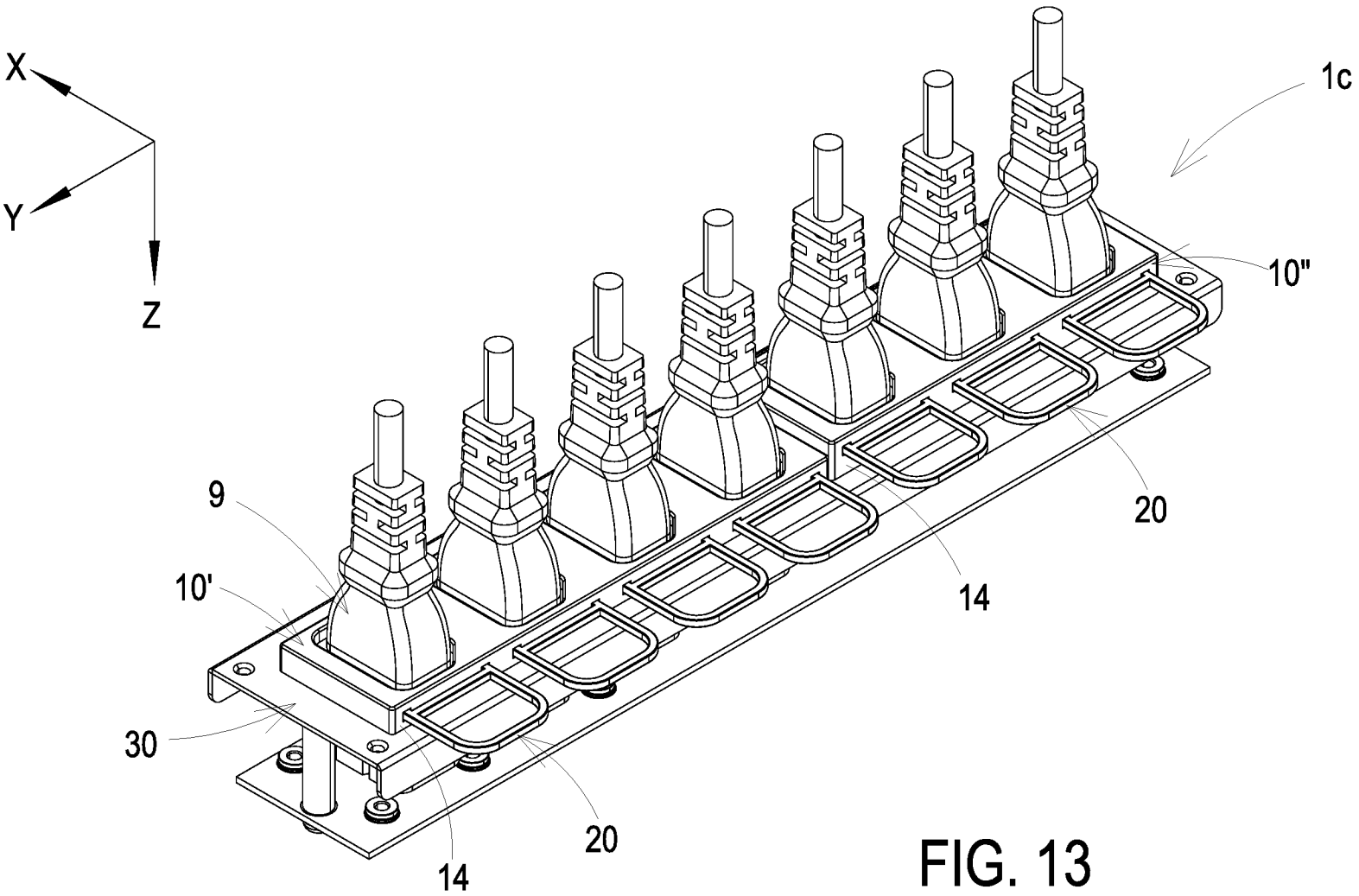
FIG. 13 is a schematic structural view illustrating a power socket and plural power plugs applied thereto according to a fourth embodiment of the present disclosure.
Figure 14:
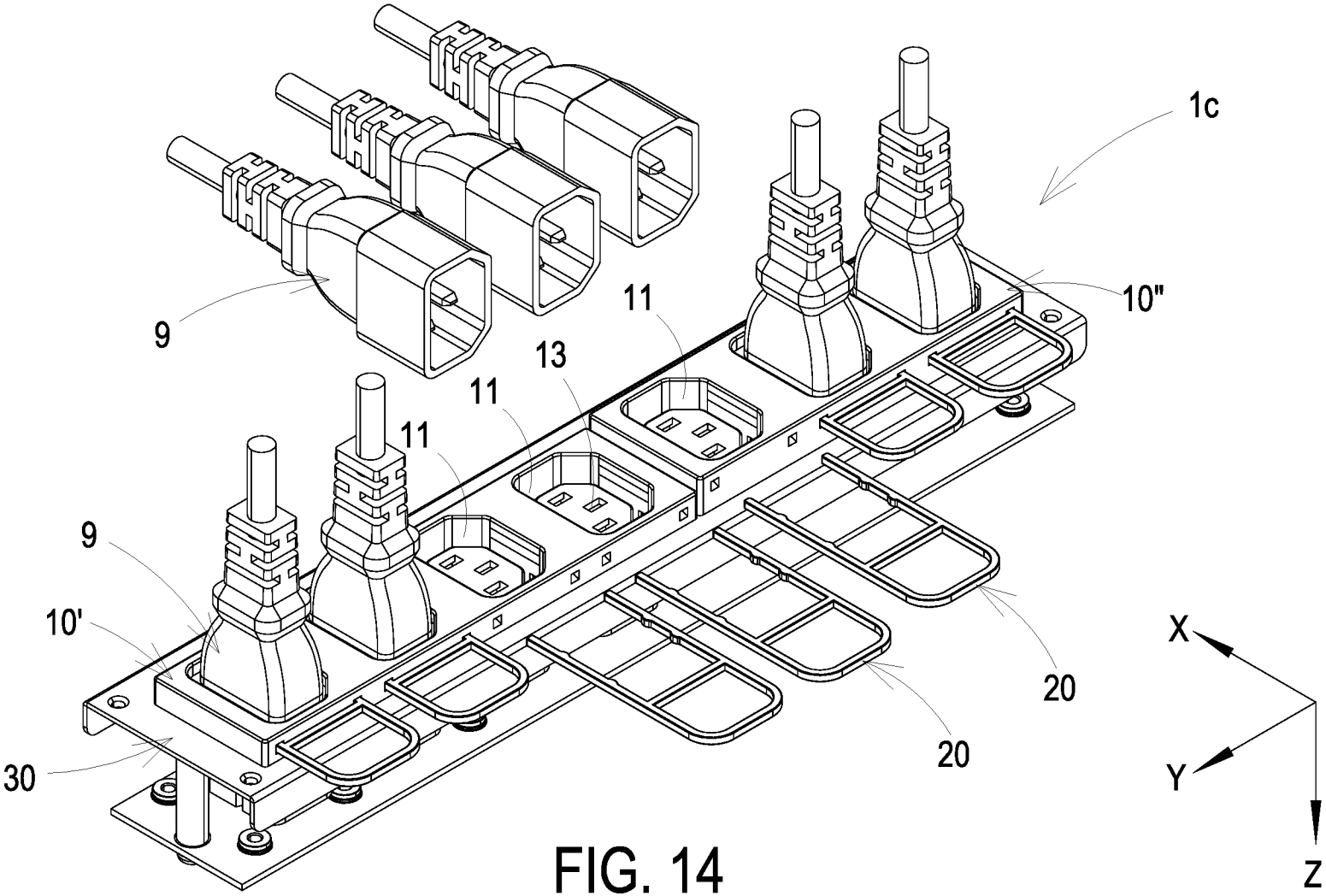
FIG. 14 is a schematic structural view illustrating the power socket of FIG. 13, wherein some power plugs are separated from the power socket.

FIG. 13 is a schematic structural view illustrating a power socket and plural power plugs applied thereto according to a fourth embodiment of the present disclosure. FIG. 14 is a schematic structural view illustrating the power socket of FIG. 13, wherein some power plugs are separated from the power socket. In the embodiment, the structures, elements and functions of the power socket 1*c* and the power plugs 9 are similar to those of the power socket 1*a* and the power plug 9 in FIGS. 6 and 7, and are not redundantly described herein. In the embodiment, the power socket 1*c* includes two main bodies 10' and 10", plural latch members 20 and a base 30. The main body 10' or the main body 10" can each be integrally formed into one group and includes plural receiving recesses 11 arranged thereon. For example, the main body 10' includes four receiving recesses 11 arranged thereon to combine with four latch members 20, and the main body 10" includes three receiving recesses 11 arranged thereon to combine with three latch members 20. In the embodiment, the corresponding relationship of one receiving recess 11 and one latch member 20 is similar to that of the foregoing embodiment, and is not redundantly described herein. The plural receiving recesses 11 are regularly arranged on at least one of the single main body 10' or the single main body 10". The main body 10' with four receiving recesses 11 and the main body 10" with three receiving recesses 11 are further arranged and disposed on the base 30 and the plural corresponding latch members 20 are disposed adjacent to the identical side 14 of the main body 10' and the main body 10". In an embodiment, the plural corresponding latch members 20 are disposed in a staggered arrangement adjacent to two opposite sides of the main body 10' or the main body 10". In other embodiments, the main body 10' and the main body 10" can be disposed on the base 30 independently, but not limited thereto. As shown in FIG. 13, in the embodiment the combination of seven sets of the receiving recesses 11 and the latch members 20 can fasten seven power plugs 9 on the main body 10' and the main body 10" of the power socket 1*c* firmly. In the embodiment, any set of the latch member 20 and the receiving recess 11 of the main body 10' or the main body 10" can be operated to switch the use state without the interference from the other combinations of the latch members 20 and the receiving recesses 11 of the main body 10' and the main bod 10". The switching operation is not affected by the arrangement of the latch members 20 and the other receiving recesses 11 of the main body 10' and the main body 10", and can be accomplished by one hand of the user. The arrangements of the latch members 20 and the receiving recesses disposed on the main body 10' and the main body 10" are not limited to the foregoing embodiment, and are not redundantly described herein. By utilizing the combination of the latch members 20 and the receiving recesses 11 integrally disposed on the main body 10' or the main body 10", it facilitates the power socket 1*c* to achieve the switching operation of latching mode (i.e. the use state at the second position) or unlatching mode (i.e. the use state at the first position) by a simple manual push-pull operation with one hand. Thus, the retaining force between the power socket 1*c* and the power plug 9 is enhanced effectively and the convenience of its operation is effectively improved. At the same time, it prevents the power plugs 9 of the server and storage system in the rack and the power socket 1*c* of the PDU from loosening caused by the human or other unintended conditions.

In summary, the present disclosure provides a power socket for enhancing a retaining force between the power socket and a power plug. With the latch member disposed within the main body of the power socket, it facilitates the power socket to achieve the switching operation of latching or unlatching by a manual push-pull operation with one hand. Thus, the retaining force between the power socket and the power plug may be enhanced effectively and the convenience of its operation may be improved. At the same time, it reduces loosening of the power plugs of the server and storage system in the rack and the power sockets of the PDU caused by the human or other unintended conditions. Moreover, by adding at least one latching slot within the main body of the power socket to receive at least one latch member, it facilitates to enhance the retaining force between the power socket and the power plug. It is not necessary to design a customized power socket to meet with the special specification and appearance of the power plug. The power socket is applicable to the general standard power plug. The structural reliability of the power socket may be improved effectively.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power socket comprising:

a main body comprising at least one connection seat, at least one receiving recess and at least one latching slot in communication with the receiving recess, wherein the connection seat is disposed within the receiving recess and configured to electrically connect with a power plug when the power plug is fitted in the receiving recess along a first direction; and at least one latch member comprising at least one arm slidable along the latching slot from a first position to a second position along a second direction, wherein the arm comprises at least one protrusion configured to slide into the receiving recess for engaging with a lateral wall of the power plug when the arm slides towards the second position.

2. The power socket according to claim 1, wherein when the arm moves towards the first position, the at least one protrusion of the arm is configured to move away from the receiving recess.

3. The power socket according to claim 1, wherein the at least one latching slot extends along the second direction inwardly from a first outer wall of the main body.

4. The power socket according to claim 1, wherein the at least one protrusion protrudes laterally from a side of the arm such that the protrusion protrudes toward the receiving recess when the arm is in the second position.

5. The power socket according to claim 1, wherein the at least one latching slot comprises a first latching slot and a second latching slot disposed on two opposite sides of the receiving recess of the main body, respectively, wherein the first latching slot and the second latching slot extends along the second direction inwardly from a first outer wall of the main body, wherein the at least one arm of the latch member comprises a first arm slidable along the first latching slot and a second arm slidable along the second latching slot, wherein the first arm comprises a first protrusion and a second protrusion, each protruding laterally from a side of the first arm such that the first protrusion and the second protrusion protrudes toward the receiving recess when the first arm is in the second position, wherein the second arm comprises a third protrusion and a fourth protrusion, each protruding laterally from a side of the second arm such that the third protrusion and the fourth protrusion protrudes toward the receiving recess when the second arm is in the second position, wherein when the power plug is fitted in the receiving recess along the first direction for electrically connecting with the connection seat, and the first arm and the second arm are operated to slide from the first position towards the second position along the second direction, the first protrusion and the second protrusion are caused to slide into the receiving recess and abut against a first lateral wall of the power plug, and the third protrusion and the fourth protrusion are caused to slide into the receiving recess and abut against a second lateral wall of the power plug.

6. The power socket according to claim 5, wherein the power plug comprises four lateral walls, the first lateral wall and the second lateral wall being located on opposite sides of the power plug, and a third lateral wall and a fourth lateral wall being located on opposite sides of the power plug, and wherein each one of the first lateral wall and the second lateral wall is wider than each one of the third lateral wall and the fourth lateral wall of the power plug.

7. The power socket according to claim 6, wherein the length of the first lateral wall is shorter than the length of the second lateral wall, and the distance between the first protrusion and the second protrusion is shorter than the distance between the third protrusion and the fourth protrusion.

8. The power socket according to claim 7, wherein the protrusions are arranged in the shape of a trapezoid such that each protrusion is located at one corner of the trapezoid.

9. The power socket according to claim 5, wherein when the first arm and the second arm move toward the first position, the first protrusion and the second protrusion of the first arm and the third protrusion and the fourth protrusion of the second arm are effected to move away from the receiving recess.

10. The power socket according to claim 5, wherein when the first arm and the second arm move toward the first position, the first protrusion and the second protrusion of the first arm are effected to move away from the first latching slot, and the third protrusion and the fourth protrusion of the second arm are effected to move away from the second latching slot.

11. The power socket according to claim 5, wherein the latch member comprises a connection part disposed between the first arm and the second arm, wherein when the first arm and the second arm are at the first position, the connection part is configured to engage with the first outer wall of the main body.

12. The power socket according to claim 11, wherein the latch member comprises a holding part disposed between the first arm and the second arm, wherein the holding part is operable to slide the first arm and the second arm along the first latching slot and the second latching slot, respectively.

13. The power socket according to claim 12, wherein the holding part comprises an opening for insertion of a finger to operate a movement of the first arm and the second arm.

14. The power socket according to claim 1, wherein the latch member comprises metal material.

15. The power socket according to claim 1, wherein the latch member comprises a holding part connected to one end of the at least one arm, and wherein the holding part is configured to be held by a user to control the at least one arm to slide along the at least one latching slot.

16. The power socket according to claim 15, wherein the holding part comprises an opening for allowing insertion of a finger of the user to control the at least one arm to slide along the at least one latching slot.

17. The power socket according to claim 15, wherein the latch member comprises a stop part disposed at an end opposite to the holding part, and wherein when the at least one arm is moved from the second position towards the first position, the stop part is configured to obstruct the latch member from being detached from the main body.

18. The power socket according to claim 17, wherein the at least one latching slot extends along the second direction inwardly from a first outer wall of the main body towards a second outer wall of the main body, and wherein the first outer wall and the second outer wall are opposite to each other, and the holding part and the stop part are adjacent to the first outer wall and the second outer wall of the main body, respectively.

19. The power socket according to claim 17, wherein the stop part comprises a barb, a hook, or a protruded stopper.

20. The power socket according to claim 15, wherein the holding part comprises a finger ring.

* * * * *